US011039251B2

(12) United States Patent
Gejo et al.

(10) Patent No.: US 11,039,251 B2
(45) Date of Patent: Jun. 15, 2021

(54) SIGNAL PROCESSING DEVICE, SIGNAL PROCESSING METHOD, AND PROGRAM

(71) Applicant: JVCKENWOOD CORPORATION, Yokohama (JP)

(72) Inventors: Takahiro Gejo, Yokohama (JP); Hisako Murata, Yokohama (JP); Yumi Fujii, Yokohama (JP); Masaya Konishi, Yokohama (JP); Kuniaki Takachi, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 16/816,852

(22) Filed: Mar. 12, 2020

(65) Prior Publication Data

US 2020/0213738 A1 Jul. 2, 2020

Related U.S. Application Data

(63) Continuation of application No. PCT/JP2018/034550, filed on Sep. 19, 2018.

(30) Foreign Application Priority Data

Sep. 27, 2017 (JP) ..... JP2017-186163

(51) Int. Cl.
*H04R 5/04* (2006.01)
*H04R 3/00* (2006.01)
(Continued)

(52) U.S. Cl.
CPC ..... *H04R 5/04* (2013.01); *H04R 3/005* (2013.01); *H04R 3/04* (2013.01); *H04R 5/027* (2013.01); *H04R 5/033* (2013.01)

(58) Field of Classification Search
CPC ..... H04R 5/04; H04R 3/005; H04R 5/033; H04R 5/027; H04R 3/04; H04S 7/302;
(Continued)

(56) References Cited

U.S. PATENT DOCUMENTS

2006/0045294 A1 3/2006 Smyth
2009/0154712 A1* 6/2009 Morii ..... G01C 21/3629 381/1

(Continued)

FOREIGN PATENT DOCUMENTS

JP H089489 A * 1/1996
JP 2008-512015 A 4/2008

(Continued)

*Primary Examiner* — Yogeshkumar Patel
(74) *Attorney, Agent, or Firm* — Procopio, Cory, Hargreaves & Savitch LLP

(57) ABSTRACT

A signal processing device of an embodiment includes a measurement signal generation unit that generates a measurement signal to be output from the sound source, a sound pickup signal acquisition unit that acquires sound pickup signals picked up by a plurality of microphones, a sound source information acquisition unit that acquires sound source information about a horizontal angle of a sound source, filters that have a passband set based on the sound source information and output a filter passing signal in response to input of the sound pickup signals, a phase difference detection unit that detects a phase difference between two sound pickup signals based on the filter passing signal, and a determination unit that determines a result of measurement of the sound pickup signals by comparing the phase difference with an effective range set based on the sound source information.

6 Claims, 11 Drawing Sheets

(51) Int. Cl.
*H04R 3/04* (2006.01)
*H04R 5/027* (2006.01)
*H04R 5/033* (2006.01)

(58) Field of Classification Search
CPC ..... H04S 7/304; H04S 2420/01; H04S 7/303; G10K 15/00
See application file for complete search history.

(56) References Cited

U.S. PATENT DOCUMENTS

| | | | | |
|---|---|---|---|---|
| 2011/0299707 | A1* | 12/2011 | Meyer | H04S 7/304 381/310 |
| 2017/0188172 | A1* | 6/2017 | Horbach | H04S 7/304 |

FOREIGN PATENT DOCUMENTS

| | | | | | |
|---|---|---|---|---|---|
| JP | 2016031243 | A | * | 3/2016 | H04R 3/00 |
| WO | 2006/024850 | A2 | | 3/2006 | |
| WO | WO-2016167007 | A1 | * | 10/2016 | H04S 1/00 |
| WO | WO-2017046984 | A1 | * | 3/2017 | H04S 3/008 |

* cited by examiner

SIGNAL PROCESSING DEVICE, SIGNAL PROCESSING METHOD, AND PROGRAM

CROSS REFERENCE TO RELATED APPLICATION

This application a Bypass Continuation of International Application No. PCT/JP2018/034550 filed on Sep. 19, 2018, which is based upon and claims the benefit of priority from Japanese patent application No. 2017-186163 filed on Sep. 27, 2017, the disclosure of which is incorporated herein in its entirety by reference.

BACKGROUND

The present invention relates to a signal processing device, a signal processing method, and a program.

Patent Literature 1 (Published Japanese Translation of PCT International Publication for Patent Application, No. 2008-512015) discloses a control device and a measurement system for measuring head-related transfer function (HRTF). In the measurement system of Patent Literature 1, microphones (which can be also called "mike") are worn on the ears of a user to picks up measurement signals from a speaker. Further, in Patent Literature 1, two cameras detect the position of the speaker with respect to the user. The amount of movement of the user's head is detected from the photo shooting result of the cameras. When the amount of movement is large, a buzzer signal indicating an error is output.

Further, the distance between the user's head and the speaker is calculated from stereo images of the cameras. The sound volume of HRTF is modified in accordance with the calculated distance. Further, Patent Literature 1 discloses measurement using a smartphone equipped with a speaker, a camera and a memory.

SUMMARY

Because the shapes of the head and the auricle vary from person to person, HRTF (which is also referred to as spatial acoustic transfer characteristics) also varies from person to person. By use of the HRTF of an actual listener, localization with higher accuracy is achieved. As a storage device with higher-capacity and smaller-size and an arithmetic device capable of high-speed computing have been widespread with smartphones recently, it has become possible to measure the HRTF of an actual listener at the listener's home or the like.

However, there are cases where measurement cannot be done appropriately due to some reasons. Such cases include when the positions to wear microphones are not appropriate, when there are many disturbances and the S/N ratio is low, when the listening environment is not suitable for measurement or the like, for example.

Because expert knowledge is required to determine whether or not measurement is done appropriately, it is difficult for general users to make determination. Further, for even an expert with expert knowledge, it can take time and effort, such as analyzing a signal waveform, to fully examine acquired sound pickup signals.

The present embodiment has been accomplished to solve the above problems and an object of the present invention is thus to provide a signal processing device, a signal processing method and a program capable of determining whether a sound pickup signal is acquired appropriately.

A signal processing device according to an embodiment is a signal processing device for processing sound pickup signals obtained by picking up a sound output from a sound source by a plurality of microphones worn on a user, including a measurement signal generation unit configured to generate a measurement signal to be output from the sound source, a sound pickup signal acquisition unit configured to acquire sound pickup signals picked up by the plurality of microphones, a sound source information acquisition unit configured to acquire sound source information related to a horizontal angle of the sound source, a filter configured to have a passband set based on the sound source information, and output a filter passing signal in response to input of the sound pickup signals, a phase difference detection unit configured to detect a phase difference between two sound pickup signals based on the filter passing signal, and a determination unit configured to determine a result of measurement of the sound pickup signals by comparing the phase difference with an effective range set based on the sound source information.

A signal processing method according to an embodiment is a signal processing method for processing sound pickup signals obtained by picking up a sound output from a sound source by a plurality of microphones worn on a user, the method including a step of generating a measurement signal to be output from the sound source, a step of acquiring sound pickup signals picked up by the plurality of microphones, a step of acquiring sound source information related to a horizontal angle of the sound source, a step of inputting the sound pickup signals to a filter having a passband set based on the sound source information, a step of detecting a phase difference between two sound pickup signals based on a filter passing signal having passed through the filter, and a step of determining a result of measurement of the sound pickup signals by comparing the phase difference with an effective range set based on the sound source information.

A program according to an embodiment causes a computer to execute a signal processing method for processing sound pickup signals obtained by picking up a sound output from a sound source by a plurality of microphones worn on a user, the signal processing method including a step of generating a measurement signal to be output from the sound source, a step of acquiring sound pickup signals picked up by the plurality of microphones, a step of acquiring sound source information related to a horizontal angle of the sound source, a step of inputting the sound pickup signals to a filter having a passband set based on the sound source information, a step of detecting a phase difference between two sound pickup signals based on a filter passing signal having passed through the filter, and a step of determining a result of measurement of the sound pickup signals by comparing the phase difference with an effective range set based on the sound source information.

DETAILED DESCRIPTION

The overview of a sound localization process using a filter generated by a signal processing device according to an embodiment is described hereinafter. An out-of-head localization process according to this embodiment performs out-of-head localization by using spatial acoustic transfer characteristics and ear canal transfer characteristics. The spatial acoustic transfer characteristics are transfer characteristics from a sound source such as speakers to the ear canal. The ear canal transfer characteristics are transfer characteristics from the entrance of the ear canal to the eardrum. In this embodiment, out-of-head localization is implemented by measuring the spatial sound transfer characteristics when headphones or earphones are not worn, measuring the ear canal transfer characteristics when headphones or earphones are worn, and using those measurement data.

Out-of-head localization according to this embodiment is performed by a user terminal such as a personal computer, a smart phone, or a tablet PC. The user terminal is an information processor including a processing means such as a processor, a storage means such as a memory or a hard disk, a display means such as a liquid crystal monitor, and an input means such as a touch panel, a button, a keyboard and a mouse. The user terminal may have a communication function to transmit and receive data. Further, an output means (output unit) with headphones or earphones is connected to the user terminal.

First Embodiment (Out-of-Head Localization Device)

Figure 1:
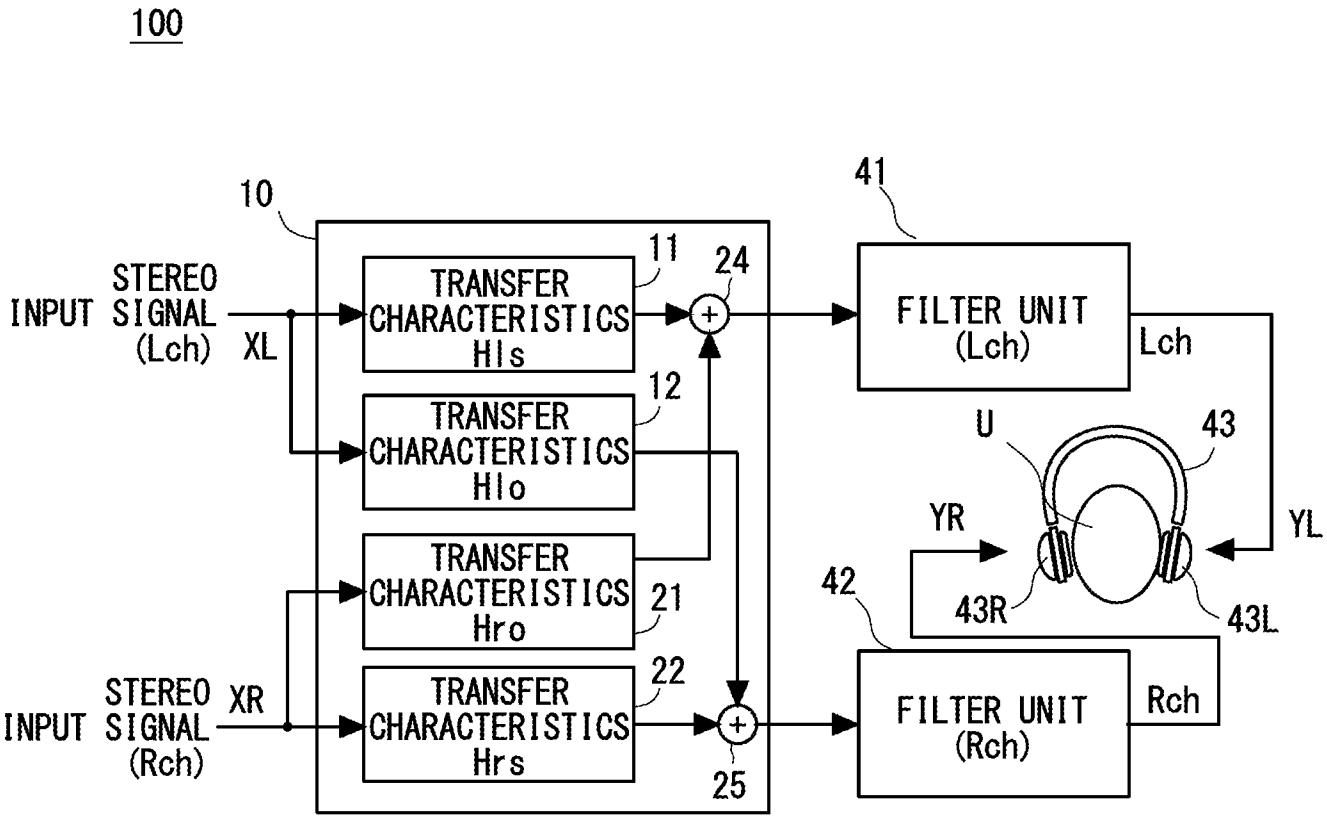
FIG. 1 is a block diagram showing an out-of-head localization device according to an embodiment.

FIG. 1 shows an out-of-head localization device 100, which is an example of a sound field reproduction device according to this embodiment. FIG. 1 is a block diagram of the out-of-head localization device 100. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are analog audio reproduced signals that are output from a CD (Compact Disc) player or the like or digital audio data such as mp3 (MPEG Audio Layer-3). Note that the out-of-head localization device 100 is not limited to a physically single device, and a part of processing may be performed in a different device. For example, a part of processing may be performed by a personal computer or the like, and the rest of processing may be performed by a DSP (Digital Signal Processor) included in the headphones 43 or the like.

The out-of-head localization device 100 includes an out-of-head localization unit 10, a filter unit 41, a filter unit 42, and headphones 43. The out-of-head localization unit 10, the filter unit 41 and the filter unit 42 can be implemented by a processor or the like, to be specific.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves a filter of the spatial acoustic transfer characteristics (which is referred hereinafter also as a spatial acoustic filter) into each of the stereo input signals XL and XR having the respective channels. The spatial acoustic transfer characteristics may be a head-related transfer function HRTF measured in the head or auricle of a measured person, or may be the head-related transfer function of a dummy head or a third person.

The spatial acoustic transfer characteristics are a set of four spatial acoustic transfer characteristics Hls, Hlo, Hro and Hrs. Data used for convolution in the convolution calculation units 11 to 12 and 21 to 22 is a spatial acoustic filter. The spatial acoustic filter is generated by cutting out the spatial acoustic transfer characteristics Hls, Hlo, Hro and Hrs with a specified filter length.

Each of the spatial acoustic transfer characteristics Hls, Hlo, Hro and Hrs is acquired in advance by impulse response measurement or the like. For example, the user U wears microphones on the left and right ears, respectively. Left and right speakers placed in front of the user U output impulse sounds for performing impulse response measurement. Then, the microphones pick up measurement signals such as the impulse sounds output from the speakers. The spatial acoustic transfer characteristics Hls, Hlo, Hro and Hrs are acquired based on sound pickup signals in the microphones. The spatial acoustic transfer characteristics Hls between the left speaker and the left microphone, the spatial acoustic transfer characteristics Hlo between the left speaker and the right microphone, the spatial acoustic transfer characteristics Hro between the right speaker and the left microphone, and the spatial acoustic transfer characteristics Hrs between the right speaker and the right microphone are measured.

The convolution calculation unit 11 convolves the spatial acoustic filter in accordance with the spatial acoustic transfer characteristics His to the L-ch stereo input signal XL. The convolution calculation unit 11 outputs convolution calculation data to the adder 24. The convolution calculation unit 21 convolves the spatial acoustic filter in accordance with the spatial acoustic transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves the spatial acoustic filter in accordance with the spatial acoustic transfer characteristics Hlo to the L-ch stereo input signal XL. The convolution calculation unit 12 outputs convolution calculation data to the adder 25. The convolution calculation unit 22 convolves the spatial acoustic filter in accordance with the spatial acoustic transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels out the headphone characteristics (characteristics between a reproduction unit of headphones and a microphone) is set to the filter units 41 and 42. Then, the inverse filter is convolved to the reproduced signals (convolution calculation signals) on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels out the characteristics from the headphone unit to the microphone when the headphones 43 are worn. The microphone may be placed at any position between the entrance of the ear canal and the eardrum. The inverse filter is calculated from a result of measuring the characteristics of the user U as described later.

The filter unit 41 outputs a processed L-ch signal to a left unit 43L of the headphones 43. The filter unit 42 outputs a processed R-ch signal to a right unit 43R of the headphones 43. The user U is wearing the headphones 43. The headphones 43 output the L-ch signal and the R-ch signal toward the user U. It is thereby possible to reproduce sound images localized outside the head of the user U.

As described above, the out-of-head localization device 100 performs out-of-head localization by using the spatial acoustic filters in accordance with the spatial acoustic transfer characteristics Hls, Hlo, Hro and Hrs and the inverse filters of the headphone characteristics. In the following description, the spatial acoustic filters in accordance with the spatial acoustic transfer characteristics Hls, Hlo, Hro and Hrs and the inverse filter of the headphone characteristics are referred to collectively as an out-of-head localization filter. In the case of 2ch stereo reproduced signals, the out-of-head localization filter is composed of four spatial acoustic filters and two inverse filters. The out-of-head localization device 100 then carries out convolution calculation on the stereo reproduced signals by using the total six out-of-head localization filters and thereby performs out-of-head localization.

(Filter Generation Device)

Figure 2:
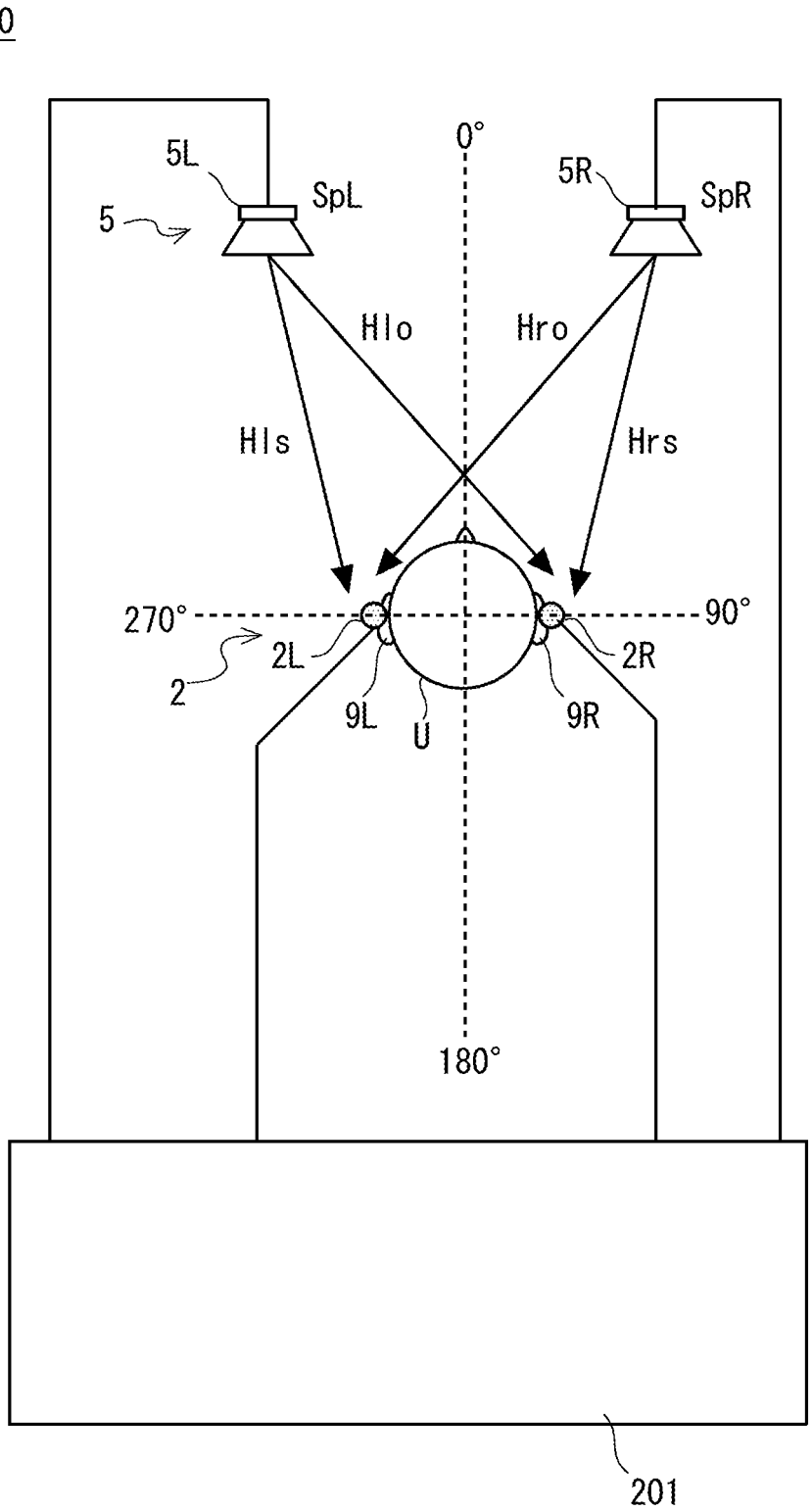
FIG. 2 is a view showing a filter generation device.

A filter generation device that measures spatial acoustic transfer characteristics (which are referred to hereinafter as transfer characteristics) and generates filters is described hereinafter with reference to FIG. 2. FIG. 2 is a view schematically showing the structure of a filter generation device 200. Note that the filter generation device 200 may be a common device to the out-of-head localization device 100 shown in FIG. 1. Alternatively, a part or the whole of the filter generation device 200 may be a different device from the out-of-head localization device 100.

As shown in FIG. 2, the filter generation device 200 includes stereo speakers 5, stereo microphones 2, and a signal processing device 201. The stereo speakers 5 are placed in a measurement environment. The measurement environment may be the user U's room at home, a dealer or showroom of an audio system or the like. In the measurement environment, sounds are reflected on a floor surface or a wall surface.

In this embodiment, the signal processing device 201 of the filter generation device 200 performs processing for appropriately generating filters in accordance with the transfer characteristics. The signal processing device 201 may be a personal computer (PC), a tablet terminal, a smart phone or the like.

The signal processing device 201 generates a measurement signal and outputs it to the stereo speakers 5. Note that the signal processing device 201 generates an impulse signal, a TSP (Time Stretched Pulse) signal or the like as the measurement signal for measuring the transfer characteristics. The measurement signal contains a measurement sound such as an impulse sound. Further, the signal processing device 201 acquires a sound pickup signal picked up by the stereo microphones 2. The signal processing device 201 includes a memory or the like that stores measurement data of the transfer characteristics.

The stereo speakers 5 include a left speaker 5L and a right speaker 5R. For example, the left speaker 5L and the right speaker 5R are placed in front of a listener 1. The left speaker 5L and the right speaker 5R output impulse sounds for impulse response measurement and the like. Although the number of speakers, which serve as sound sources, is 2 (stereo speakers) in this embodiment, the number of sound sources to be used for measurement is not limited to 2, and it may be 1 or more. Therefore, this embodiment is applicable also to 1ch mono or 5.1ch, 7.1ch etc. multichannel environment. In the case of 1ch, measurement may be performed with one speaker placed at the left speaker 5L, and measurement may be further performed after this speaker is moved to the position of the right speaker 5R.

The stereo microphones 2 include a left microphone 2L and a right microphone 2R. The left microphone 2L is placed on a left ear 9L of the user U, and the right microphone 2R is placed on a right ear 9R of the listener 1. To be specific, the microphones 2L and 2R are preferably placed at a position between the entrance of the ear canal and the eardrum of the left ear 9L and the right ear 9R, respectively. The microphones 2L and 2R pick up measurement signals output from the stereo speakers 5 and output sound pickup signals to the signal processing device 201. The user U may be a person or a dummy head. In other words, in this embodiment, the user U is a concept that includes not only a person but also a dummy head.

As described above, impulse sounds output from the left and right speakers 5L and 5R are picked up by the microphones 2L and 2R, respectively, and impulse response is obtained based on the sound pickup signals. The filter generation device 200 stores the sound pickup signals acquired based on the impulse response measurement into a memory or the like. The transfer characteristics Hls between the left speaker 5L and the left microphone 2L, the transfer characteristics Hlo between the left speaker 5L and the right microphone 2R, the transfer characteristics Hro between the right speaker 5R and the left microphone 2L, and the transfer characteristics Hrs between the right speaker 5R and the right microphone 2R are thereby measured. Specifically, the left microphone 2L picks up the measurement signal that is output from the left speaker 5L, and thereby the transfer characteristics Hls are acquired. The right microphone 2R picks up the measurement signal that is output from the left speaker 5L, and thereby the transfer characteristics Hlo are acquired. The left microphone 2L picks up the measurement signal that is output from the right speaker 5R, and thereby the transfer characteristics Hro are acquired. The right microphone 2R picks up the measurement signal that is output from the right speaker 5R, and thereby the transfer characteristics Hrs are acquired.

Then, the filter generation device 200 generates filters in accordance with the transfer characteristics Hls, Hlo, Hro and Hrs from the left and right speakers 5L and 5R to the left and right microphones 2L and 2R based on the sound pickup signals. Specifically, the spatial acoustic filter is generated by cutting out the transfer characteristics Hls, Hlo, Hro and Hrs with a specified filter length. In this manner, the filter generation device 200 generates filters to be used for convolution calculation of the out-of-head localization device 100. As shown in FIG. 1, the out-of-head localization device 100 performs out-of-head localization by using the filters in accordance with the transfer characteristics Hls, Hlo, Hro and Hrs between the left and right speakers 5L and 5R and the left and right microphones 2L and 2R. Specifically, it performs out-of-head localization by convolving the filters in accordance with the transfer characteristics to the audio reproduced signals.

Figure 3:
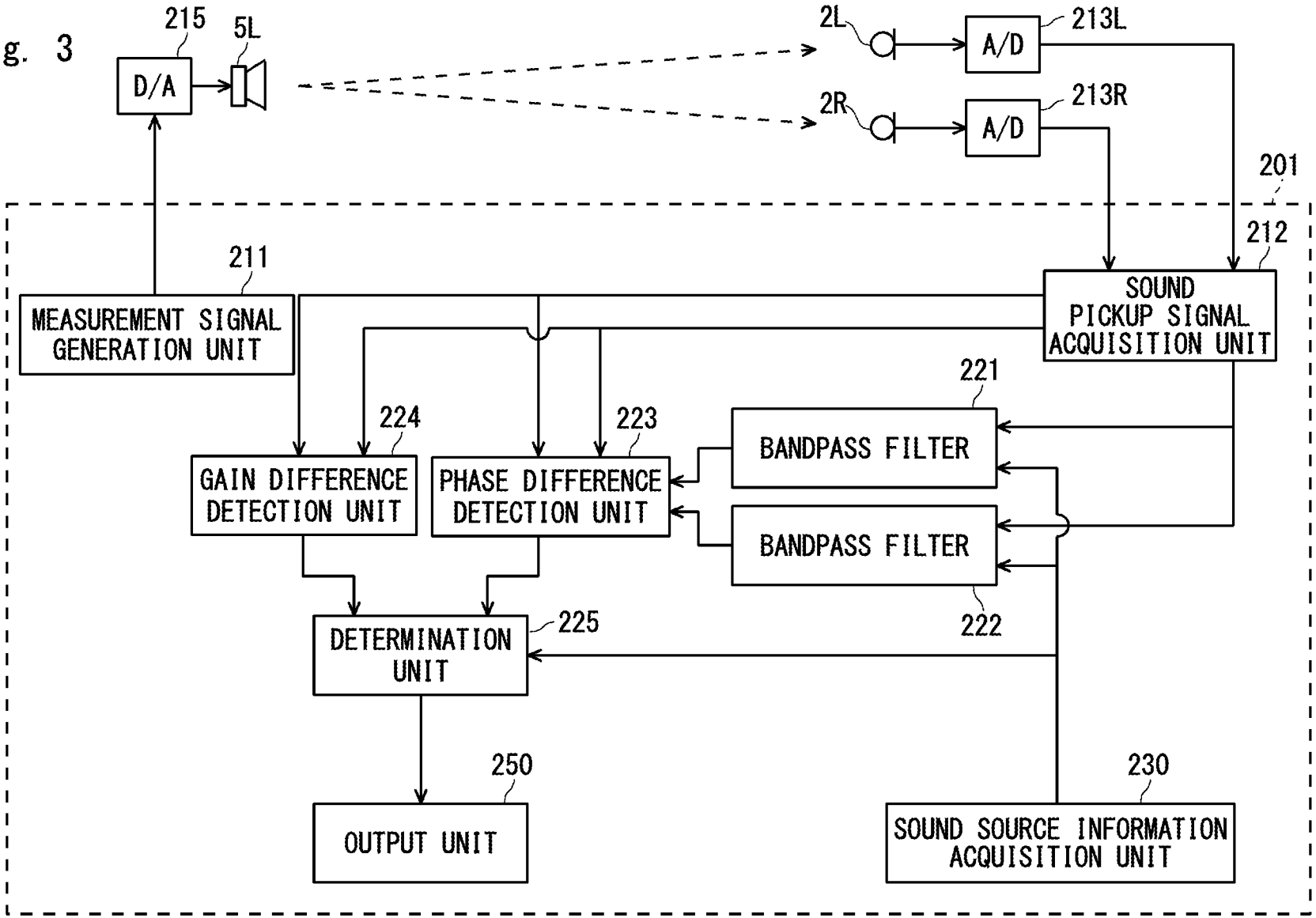
FIG. 3 is a control block diagram showing the structure of a signal processing device according to a first embodiment.

Further, in this embodiment, the signal processing device 201 determines whether sound pickup signals are appropriately acquired or not. Specifically, the signal processing device 201 makes determination as to whether the sound pickup signals acquired by the left and right microphones 2L and 2R are appropriate or not. To be more specific, the signal processing device 201 makes determination based on a phase difference between the sound pickup signal (which is referred to hereinafter as Lch sound pickup signal) acquired by the left microphone 2L and the sound pickup signal (which is referred to hereinafter as Rch sound pickup signal) acquired by the right microphone 2R. The determination in the signal processing device 201 is described hereinafter in detail with reference to FIG. 3.

Note that, because the filter generation device 200 performs the same measurement on each of the left speaker 5L and the right speaker 5R, the case where the left speaker 5L is used as the sound source is described below. Measurement using the right speaker 5R as the sound source can be performed in the same manner as measurement using the left speaker 5L as the sound source, and therefore the illustration of the right speaker 5R is omitted in FIG. 3.

The signal processing device 201 includes a measurement signal generation unit 211, a sound pickup signal acquisition unit 212, a bandpass filter 221, a bandpass filter 222, a phase difference detection unit 223, a gain difference detection unit 224, a determination unit 225, a sound source information acquisition unit 230 and an output unit 250.

The signal processing device 201 is an information processing device such as a personal computer or a smartphone, and it includes a memory and a CPU. The memory stores a processing program, parameters, measurement data and the like. The CPU executes the processing program stored in the memory. As a result that the CPU executes the processing program, processing in the measurement signal generation unit 211, the sound pickup signal acquisition unit 212, the bandpass filter 221, the bandpass filter 222, the phase difference detection unit 223, the gain difference detection unit 224 the a determination unit 225, the sound source information acquisition unit 230 and the output unit 250 are performed.

The measurement signal generation unit 211 generates a measurement signal to be output from a sound source. The measurement signal generated by the measurement signal generation unit 211 is converted from digital to analog by a D/A converter 215 and output to the left speaker 5L. Note that the D/A converter 215 may be included in the signal processing device 201 or the left speaker 5L. The left speaker 5L outputs a measurement signal for measuring the transfer characteristics. The measurement signal may be an impulse signal, a TSP (Time Stretched Pulse) signal or the like. The measurement signal contains a measurement sound such as an impulse sound.

Each of the left microphone 2L and the right microphone 2R of the stereo microphones 2 picks up the measurement signal, and outputs the sound pickup signal to the signal processing device 201. The sound pickup signal acquisition unit 212 acquires the sound pickup signals picked up by the left microphone 2L and the right microphone 2R. The sound pickup signals from the microphones 2L and 2R are converted from analog to digital by A/D converters 213L or 213R and input to the sound pickup signal acquisition unit 212. The sound pickup signal acquisition unit 212 may perform synchronous addition of the signals obtained by a plurality of times of measurement. Because an impulse sound output from the left speaker 5L is picked up in this example, the sound pickup signal acquisition unit 212 acquires the sound pickup signal corresponding to the transfer characteristics Hls and the sound pickup signal corresponding to the transfer characteristics Hlo.

The sound pickup signal acquisition unit 212 outputs the Lch sound pickup signal to the bandpass filter 221, and outputs the Rch sound pickup signal to the bandpass filter 222. The bandpass filters 221 and 222 have a specified passband. Thus, a signal component in the passband passes through the bandpass filter 221 or the bandpass filter 222, and a signal component in a stopband outside the passband is blocked by the bandpass filter 221 or the bandpass filter 222. The bandpass filter 221 and the bandpass filter 222 are filters having the same characteristics. Thus, the passbands of the Lch bandpass filter 221 and the Rch bandpass filter 222 are the same frequency band.

The signals that have passed through the bandpass filters 221 or 222 are referred to as filter passing signals. The bandpass filter 221 outputs the Lch filter passing signal to the phase difference detection unit 223. The bandpass filter 222 outputs the Rch filter passing signal to the phase difference detection unit 223.

The sound source information acquisition unit 230 acquires sound source information related to a horizontal angle of a sound source and outputs this information to the bandpass filters 221 and 222. The horizontal angle is the angle of the speakers 5L and 5R with respect to the user U in the horizontal plane. A user or another person inputs a direction with a touch panel or the like of a smartphone, and the sound source information acquisition unit 230 acquires the horizontal angle from a result of this input. Alternatively, a user or the like may directly input the value of the horizontal angle as the sound source information by using a keyboard, a mount or the like. Further, the sound source information acquisition unit 230 may acquire the horizontal angle of the sound source detected by a sensor as the sound source information. The sound source information may contain not only the horizontal angle but also a vertical angle (elevation angle) of a sound source (speaker). Further, the sound source information may contain distance information from the user U to a sound source, shape information of a room as a measurement environment or the like.

The passbands of the bandpass filters 221 and 222 are set based on the sound source information. Thus, the passbands of the bandpass filters 221 and 222 vary depending on the horizontal angle. The bandpass filters 221 and 222 have the passband that is set based on the sound source information, and receive sound pickup signals and output filter passing signal. The passbands of the bandpass filter 221 and the bandpass filter 222 are described later.

The filter passing signals from the bandpass filter 221 and the bandpass filter 222 are input to the phase difference detection unit 223. The phase difference detection unit 223 detects a phase difference between the two sound pickup signals based on the filter passing signals. Further, the sound pickup signal acquisition unit 212 outputs the sound pickup signals to the phase difference detection unit 223. The phase difference detection unit 223 detects a phase difference between the left and right sound pickup signals based on the Lch sound pickup signal, the Rch sound pickup signal, and the Lch filter passing signal, and the Rch filter passing signal. The detection of a phase difference by the phase difference detection unit 223 is described later. The phase difference detection unit 223 outputs the detected phase difference to the determination unit 225.

Further, the sound pickup signal acquisition unit 212 outputs the sound pickup signals to the gain difference detection unit 224. The gain difference detection unit 224 detects a gain difference between the left and right sound pickup signals based on the Lch and Rch sound pickup signals. The detection of a gain difference by the gain difference detection unit 224 is described later. The gain difference detection unit 224 outputs the detected gain difference to the determination unit 225.

The determination unit 225 determines whether the sound pickup signals are appropriate based on the phase difference and the gain difference. Specifically, the determination unit 225 determines whether measurement of the sound pickup signals by the filter generation device 200 shown in FIG. 2 is appropriate or not. The determination unit 225 determines "good" when the measurement is appropriate, and determines "no good" when the measurement is inappropriate. When the result of measurement is good, the filter generation device 200 generates a filter based on the sound pickup signals. When, on the other hand, the result of measurement is not good, the determination unit 225 carries out remeasurement.

Further, the sound source information from the sound source information acquisition unit 230 is input to the determination unit 225. The sound source information is information related to the horizontal angle of the speaker 5L, which is the sound source, as described above. Based on the sound source information, the determination unit 225 calculates the effective range of the gain difference and the effective range of the phase difference. The determination unit 225 compares the phase difference and the gain difference with the respective effective ranges and thereby makes a determination. The determination unit 225 determines results of measurement of the sound pickup signals by comparing the phase difference with the effective range that is set based on the sound source information. Further, the determination unit 225 determines results of measurement of the sound pickup signals by comparing the gain difference with the effective range that is set based on the sound source information. For example, those effective ranges are defined by two thresholds, which are, an upper limit and a lower limit.

To be specific, when the phase difference calculated by the phase difference detection unit 223 is within the effective range of the phase difference, the determination unit 225 determines that the result is good. When it is not within the effective range of the phase difference, the determination unit 225 determines that the result is not good. When the gain difference calculated by the gain difference detection unit 224 is within the effective range of the gain difference, the determination unit 225 determines that a result is good. When it is not within the effective range of the gain difference, the determination unit 225 determines that the result is not good.

The determination unit 225 makes determination based on both of the phase difference and the gain difference. For example, the determination unit 225 may determine that the result is good when both of the phase difference and the gain difference are within the respective effective ranges, and it may determine that the result is not good when at least one of the phase difference and the gain difference is not within the effective range. It is thereby possible to make accurate determination. As a matter of course, the determination unit 225 may make determination based on only one of the phase difference and the gain difference.

The determination unit 225 outputs the determination result to the output unit 250. The output unit 250 outputs the determination result of the determination unit 225. When the result of measurement is good, the output unit 250 notifies the user U that the result is good. When the result of measurement is not good, the output unit 250 notifies the user U that the result is not good. For example, the output unit 250 includes a monitor or the like and displays the determination result. Further, when the determination result is not good, the output unit 250 may perform display to prompt remeasurement. Furthermore, when the determination result is not good, the output unit 250 may generate an alarm signal, and the speaker may output an alarm sound.

Further, the determination unit 225 may determine an item to be adjusted in accordance with a result of comparison of the phase difference and the gain difference with the effective range. Then, the output unit 250 may notify the user U of the item to be adjusted. For example, the output unit 250 presents a display that prompts the user to readjust the sensitivity of microphones and the fit of microphones. Then, the user U or another person makes adjustment based on the notified content and then carries out remeasurement.

(Passbands of Bandpass Filters 221 and 222)

Figure 4:
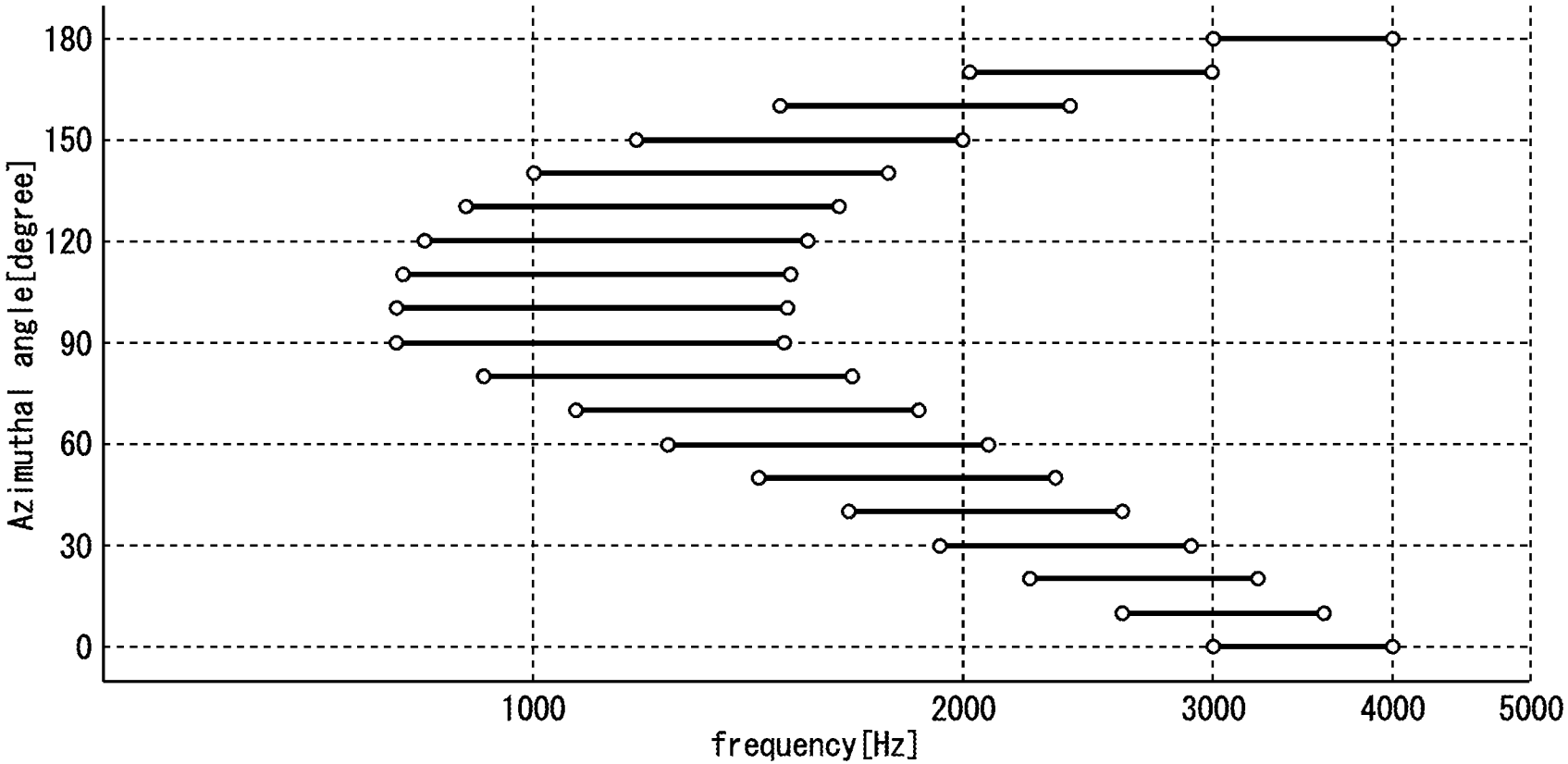
FIG. 4 is a view showing a passband of a filter in accordance with a horizontal angle.

The passbands of the bandpass filters 221 and 222 are described hereinafter with reference to FIG. 4. FIG. 4 shows an example of a table showing the horizontal angle and the passband. The horizontal axis of FIG. 4 indicates the frequency, and the vertical axis indicates the horizontal angle. FIG. 4 shows the passband at every 10 degrees of the horizontal angle. The passband is shown by the heavy line for each horizontal angle.

In this example, the horizontal angle in the forward direction of the user U is 0° (=360°), the horizontal angle in the right direction is 90°, the horizontal angle in the rearward direction is 180°, and the horizontal angle in the left direction is 270° as shown in FIG. 2. Thus, the azimuthal angle relative to the front of the user U is the horizontal angle. Because it is bilaterally symmetrical, the passbands only in the range of 0° to 180° are shown in FIG. 4, and the passbands in the range of 180° to 360° are not shown. The passbands in the range of 180° to 360° are obtained by replacing 0° in the vertical axis of FIG. 4 with 360°, 90° with 270°, 180° with 180° and the like.

The passband is lowest at the horizontal angle of 90°, where the sound source (speaker) is right beside the user. The passband is highest at the horizontal angle of 0° or 180°, where the sound source (speaker) is right in front of or behind the user. The passband becomes higher as the horizontal angle changes from 90° to 0°. The passband becomes higher as the horizontal angle changes from 90° to 180°. Setting such passbands enables appropriate calculation of a phase difference.

It is necessary to set the same passband for the bandpass filters 221 and 222 and to achieve a sufficient S/N ratio between Lch and Rch. Further, the high-frequency range is not appropriate for phase difference analysis because it is difficult to compare the degree of phase rotation. The passbands as shown in FIG. 4 are thereby set. The passbands shown in FIG. 4 are in the low- to high-frequency range that is less affected by individual differences. While the high-frequency range is significantly affected by individual differences such as the ear shape and the head width, the low- to high-frequency range is not significantly affected by individual differences. Specifically, the characteristics in the low-frequency range do not substantially vary between objects in a shape having the head above the body and the ears on the left and right sides of the head, which are objects in a human form.

Using the table as shown in FIG. 4, the signal processing device 201 sets the passbands of the bandpass filters 221 and 222 based on the horizontal angle. For example, a passband is set in advance for each angular range, and the signal processing device 201 determines a passband in accordance with the angular range including the horizontal angle. For example, when the horizontal angle is equal to or greater than 0 and smaller than 5°, the passband at 0° shown in FIG. 4 is used. When the horizontal angle is equal to or greater than 5° and smaller than 15°, the passband at 10° shown in FIG. 4 is used. In this manner, it is possible to determine the passbands based on the angular ranges of the horizontal angle.

The passbands may be set using a mathematical expression rather than the table. Further, the passbands are preferably set such that they are bilaterally symmetrical. For example, when the horizontal angle is equal to or greater than 355° and smaller than 360°, the passband at 0° shown in FIG. 4 is used, just like the case where the horizontal angle is equal to or greater than 0° and smaller than 5°. Further, the passbands may be set based on information other than the horizontal angle, such as information related to the measurement environment, for example. To be specific, it is possible to set the passbands in accordance with the position of a wall surface, a ceiling or the like in the measurement environment.

(Detection of Phase Difference)

Figure 5:
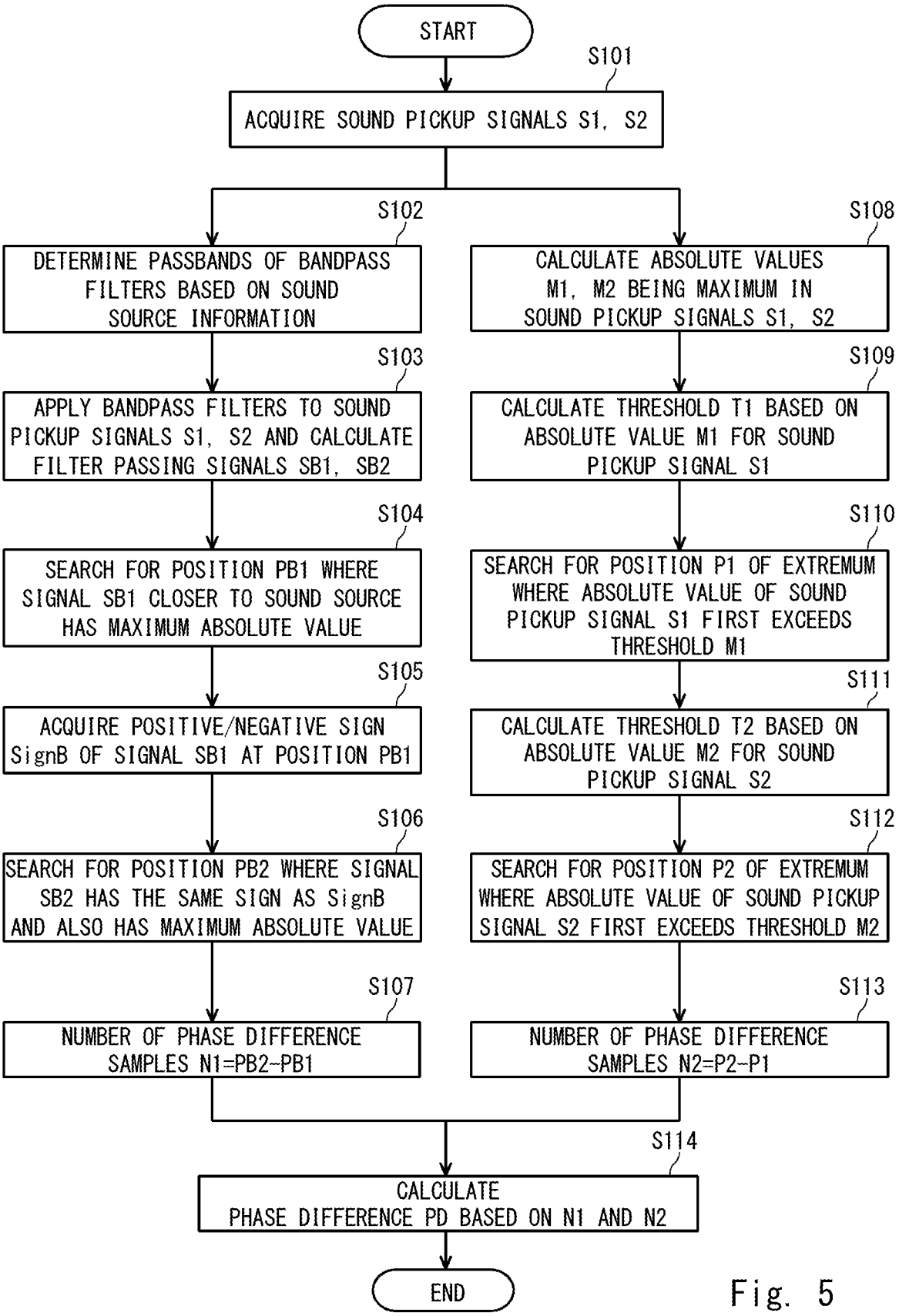
FIG. 5 is a flowchart showing a process of calculating a phase difference in a signal processing method.

A process of detecting a phase difference between left and right sound pickup signals is described hereinafter with reference to FIG. 5. FIG. 5 is a flowchart showing a process of detecting a phase difference. Although the process when the sound source is the left speaker 5L is described below, the same process applies for the right speaker 5R.

First, the sound pickup signal acquisition unit 212 acquires sound pickup signals S1 and S2 (S101). Because the sound source is the left speaker 5L, the sound pickup signal S1 that is closer to the sound source becomes the Lch sound pickup signal acquired by the left microphone 2L, and the sound pickup signal S2 that is farther from to the sound source becomes the Rch sound pickup signal acquired by the right microphone 2R. When, on the other hand, the sound source is the right speaker 5R, the sound pickup signal S1 that is closer to the sound source becomes the Rch sound pickup signal acquired by the right microphone 2R, and the sound pickup signal S2 that is farther from the sound source becomes the Lch sound pickup signal acquired by the left microphone 2L. Note that the sound pickup signals S1 and S2 are signals with the same time, i.e., with the same number of samples. The number of samples of the sound pickup signals S1 and S2 is not particularly limited; however, it is assumed that the number of samples of the sound pickup signals is 1024 for the sake of explanation in this example. Thus, the following number of samples is one integer from 0 to 1023.

Next, the signal processing device 201 determines the passbands of the bandpass filter 221 and the bandpass filter 222 based on the sound source information (S102). For example, the signal processing device 201 determines the passbands corresponding to the horizontal angle with use of the table shown in FIG. 4.

The signal processing device 201 applies the bandpass filters 221 and 222 to the sound pickup signals S1 and S2, and thereby calculates filter passing signals SB1 and SB2 (S103). The filter passing signal SB1 is the Lch sound pickup signal that is output from the bandpass filter 221, and the filter passing signal SB2 is the Rch sound pickup signal that is output from the bandpass filter 222.

The phase difference detection unit 223 searches for a position PB1 at which the filter passing signal SB1 closer to the sound source (speaker 5L) has a maximum absolute value (S104). The position PB1 is a sample number of the samples constituting the filter passing signal SB1, for example.

The phase difference detection unit 223 acquires a positive/negative sign SignB of the filter passing signal SB1 at the position PB1 (S105). The positive/negative sign SignB is a value indicating positive or negative.

The phase difference detection unit 223 searches for a position PB2 at which the filter passing signal SB2 has the same sign as the positive/negative sign SignB and also has a maximum absolute value (S106). The position PB2 is a sample number of the samples constituting the filter passing signal SB2.

Then, the phase difference detection unit 223 calculates the number of first phase difference samples N1 as N1=PB2−PB1 (S107). Specifically, the phase difference detection unit 223 calculates the number N1 of first phase difference samples by subtracting the position PB1 in the filter passing signal SB1 closer to the sound source from the position PB2 in the filter passing signal SB2 farther from the sound source.

Further, the phase difference detection unit 223 performs processing of S108 to S113 in parallel with the processing of S102 to S107. To be specific, the phase difference detection unit 223 calculates absolute values M1 and M2 that are the maximum values in the sound pickup signals S1 and S2 (S108). The absolute value M1 is the maximum of the absolute value of the sound pickup signal S1, and the absolute value M2 is the maximum of the absolute value of the sound pickup signal S2.

The phase difference detection unit 223 calculates a threshold T1 based on the absolute value M1 for the sound pickup signal S1 (S109). For example, the threshold T1 may be a value obtained by multiplying the absolute value M1 by a specified factor.

The phase difference detection unit 223 searches for a position P1 of the extremum at which the absolute value of the sound pickup signal S1 first exceeds the threshold T1 (S110). Specifically, the phase difference detection unit 223 sets, as the position P1, a sample number of the extremum whose absolute value exceeds the threshold T1 and which comes the earliest among the extrema of the sound pickup signal S1.

The phase difference detection unit 223 calculates a threshold T2 based on the absolute value M2 for the sound pickup signal S2 (S111). For example, the threshold T2 may be a value obtained by multiplying the absolute value M2 by a specified factor.

The phase difference detection unit 223 searches for a position P2 of the extremum at which the absolute value of the sound pickup signal S2 first exceeds the threshold T2 (S112). Specifically, the phase difference detection unit 223 sets, as the position P2, a sample number of the extremum whose absolute value exceeds the threshold T2 and which comes the earliest among the extrema of the sound pickup signal S2.

The phase difference detection unit 223 calculates the number of second phase difference samples N2 as N2=P2−P1 (S113). Specifically, the phase difference detection unit 223 calculates the number N2 of second phase difference samples by subtracting the position P1 in the sound pickup signal S1 closer to the sound source from the position P2 in the sound pickup signal S2 farther from the sound source.

The phase difference detection unit 223 calculates a phase difference PD based on the number N1 of first phase difference samples and the number N2 of second phase difference samples (S114). The phase difference detection unit 223 calculates, as the phase difference PD, the average of the number N1 of first phase difference samples and the number N2 of second phase difference samples. The phase difference PD may be the weighted average, rather than the simple average, of the number N1 of first phase difference samples and the number N2 of second phase difference samples.

As described above, the phase difference detection unit 223 detects the left and right phase difference PD. The processing of S102 to S107 and the processing of S108 to S113 may be performed simultaneously or sequentially. Specifically, the phase difference detection unit 223 may calculate the number N2 of second phase difference samples after calculating the number N1 of first phase difference samples. Alternatively, the phase difference detection unit 223 may calculate the number N1 of first phase difference samples after calculating the number N2 of second phase difference samples.

Note that the calculation of the phase difference PD performed in the phase difference detection unit 223 is not limited to the process shown in FIG. 5. For example, the calculation may assume that the number N1 of first phase difference samples=the phase difference PD, without using the number N2 of second phase difference samples. Alternatively, the calculation may assume that the number N2 of second phase difference samples=the phase difference PD, without using the number N1 of first phase difference samples.

Alternatively, using the cross-correlation function of the filter passing signals SB1 and SB2, the phase difference may be detected from a time difference with the highest correlation. Further, the phase difference detection unit 223 may calculate, as the phase difference, the average between the phase difference obtained by the method using the cross-correlation function and the phase difference obtained by the method shown in FIG. 5.

(Detection of Gain Difference)

Figure 6:
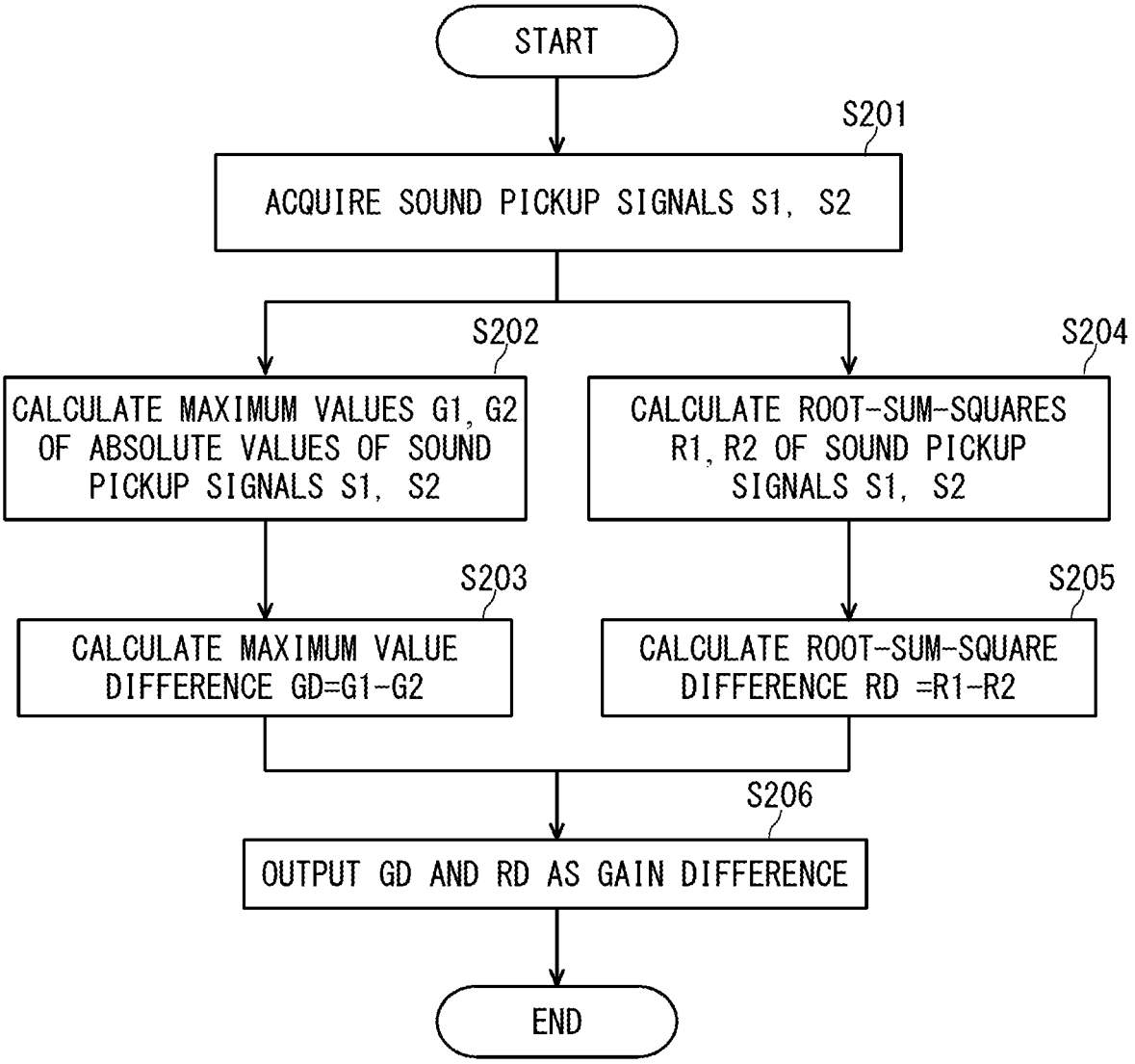
FIG. 6 is a flowchart showing a process of calculating a gain difference in a signal processing method.

A process in the gain difference detection unit 224 is described hereinafter with reference to FIG. 6. FIG. 6 is a flowchart showing a process of detecting a gain difference. Although the process when the sound source is the left speaker 5L is described below, the same process applies for the right speaker 5R. Note that the detection of the gain difference may be performed at the same time as the detection of the phase difference, or may be performed before or after the detection of the phase difference.

First, the sound pickup signal acquisition unit 212 acquires sound pickup signals S1 and S2 (S201). Because the sound source is the left speaker 5L, the sound pickup signal S1 that is closer to the sound source becomes the Lch sound pickup signal acquired by the left microphone 2L, and the sound pickup signal S2 that is farther from to the sound source becomes the Rch sound pickup signal acquired by the right microphone 2R. When, on the other hand, the sound source is the right speaker 5R, the sound pickup signal S1 that is closer to the sound source becomes the Rch sound pickup signal acquired by the right microphone 2R, and the sound pickup signal S2 that is farther from the sound source becomes the Lch sound pickup signal acquired by the left microphone 2L.

Next, the gain difference detection unit 224 calculates maximum values G1 and G2 of the absolute values of the sound pickup signals S1 and S2 (S202). Because the sound source is the left speaker 5L, the maximum value G1 is the maximum of the absolute value of the Lch sound pickup signal S1, and the maximum value G2 is the maximum of the absolute value of the Rch sound pickup signal S2.

The gain difference detection unit 224 calculates a difference between the maximum value G1 and the maximum value G2 as a maximum value difference GD (S203). Note that, because the sound source is the left speaker 5L, the maximum value difference GD can be obtained by subtracting the maximum value G2 of Rch farther from the sound source from the maximum value G1 of Lch closer to the sound source. The maximum value difference is GD=G1−G2.

Next, the gain difference detection unit 224 calculates root-sum-squares R1 and R2 of the sound pickup signals S1 and S2 (S204). The root-sum-square R1 is the root-sum-square of the Lch sound pickup signal S1, and the root-sum-square R2 is the root-sum-square of the Rch sound pickup signal S2.

The gain difference detection unit 224 calculates a difference between the root-sum-square R1 and the root-sum-square R2 as a root-sum-square difference RD (S205). Note that, because the sound source is the left speaker 5L, the root-sum-square difference RD can be obtained by subtracting the root-sum-square R2 of Rch from the root-sum-square R1 of Lch closer to the sound source. The root-sum-square difference is RD=R1−R2.

Then, the gain difference detection unit 224 outputs the maximum value difference GD and the root-sum-square difference RD as a gain difference to the determination unit 225 (S206). Note that, although the gain difference detection unit 224 calculates both of the maximum value difference GD and the root-sum-square difference RD as the gain difference, it may calculate only one of them as the gain difference.

Further, the processing of S202 to S203 and the processing of S204 to S205 may be performed simultaneously or sequentially. Specifically, the gain difference detection unit 224 may calculate the root-sum-square difference RD after calculating the maximum value difference GD. Alternatively, the gain difference detection unit 224 may calculate the maximum value difference GD after calculating the root-sum-square difference RD.

(Determination)

The determination unit 225 makes determination as to whether results of measurement are good or not based on the phase difference and the gain difference. Further, the sound source information from the sound source information acquisition unit 230 is input to the determination unit 225. Based on this sound source information, criteria to make determination are set to the determination unit 225. In this example, an effective range defined by the upper limit and the lower limit is set as criteria for determination; however, an effective range may be defined only by one of the upper limit and the lower limit.

Determination based on the phase difference is described first. An evaluation function for calculating criteria to determine whether the phase difference is appropriate or not (the effective range of the phase difference) is described hereinafter. Using the interaural time difference model described in Non Patent Literature 1 (Kuhn, G. F., "Physical Acoustics and Measurements Pertaining to Directional Hearing", in Yost, W. A. and Gourevitch, G. (eds), Directional Hearing, Springer-Verlag, pp. 3-25, 1987.), the phase difference between the ears, ITD (interaural time difference), can be represented by the following expression (1):

$$ITD=(2a/c)\sin\theta[sec] \quad (1).$$

In the above expression, c indicates the sound velocity, a indicates the radius when the horizontal cross-section of the human head is a circle, and θ is the angle in the sound source direction. Using the expression (1) as the evaluation function, the number of samples ITDS corresponding to the phase difference of the sound pickup signals, which are discrete signals, is represented by the following expression (2), where the sampling frequency of the sound pickup signals is f:

$$ITDS=(2af/c)\sin\theta[sample] \quad (2).$$

In consideration of individual differences of the human head size, the range of a is set to 0.065 to 0.095 [m]. When the horizontal angle of the sound source is 45°, the range of θ is set to 40π/180 to 50π/180 [rad] in consideration of errors. When the sound velocity is 340 [m/sec] and the sampling frequency is 48000 [Hz], the effective range ITDSR of ITDS is 11.8 [sample] to 20.5 [sample]. The range of θ may be set in accordance with the horizontal angle of the sound source.

When the phase difference PD calculated by the phase difference detection unit 223 is within the effective range ITDSR, the determination unit 225 determines that the result is good. When, on the other hand, the phase difference PD calculated by the phase difference detection unit 223 is outside the effective range ITDSR, the determination unit 225 determines that the result is not good.

Although variation of the sound velocity due to temperature and humidity is not taken into consideration in the above-described evaluation function, the behavior of the sound velocity may be taken into consideration in the calculation of the effective range. Further, although the evaluation function is defined using only the horizontal angle of the sound source, there is a case where the influence of not only direct sound but also reflected sound is not negligible in some actual environment where sound pickup signals are measured. In such a case, simulation of reflected sound may be carried out by inputting not only the horizontal angle of the sound source but also the ceiling height of the room, the distance to the wall of the room and the like. The evaluation function of the phase difference or the passband table of the bandpass filters may be changed in this manner.

Figure 7:
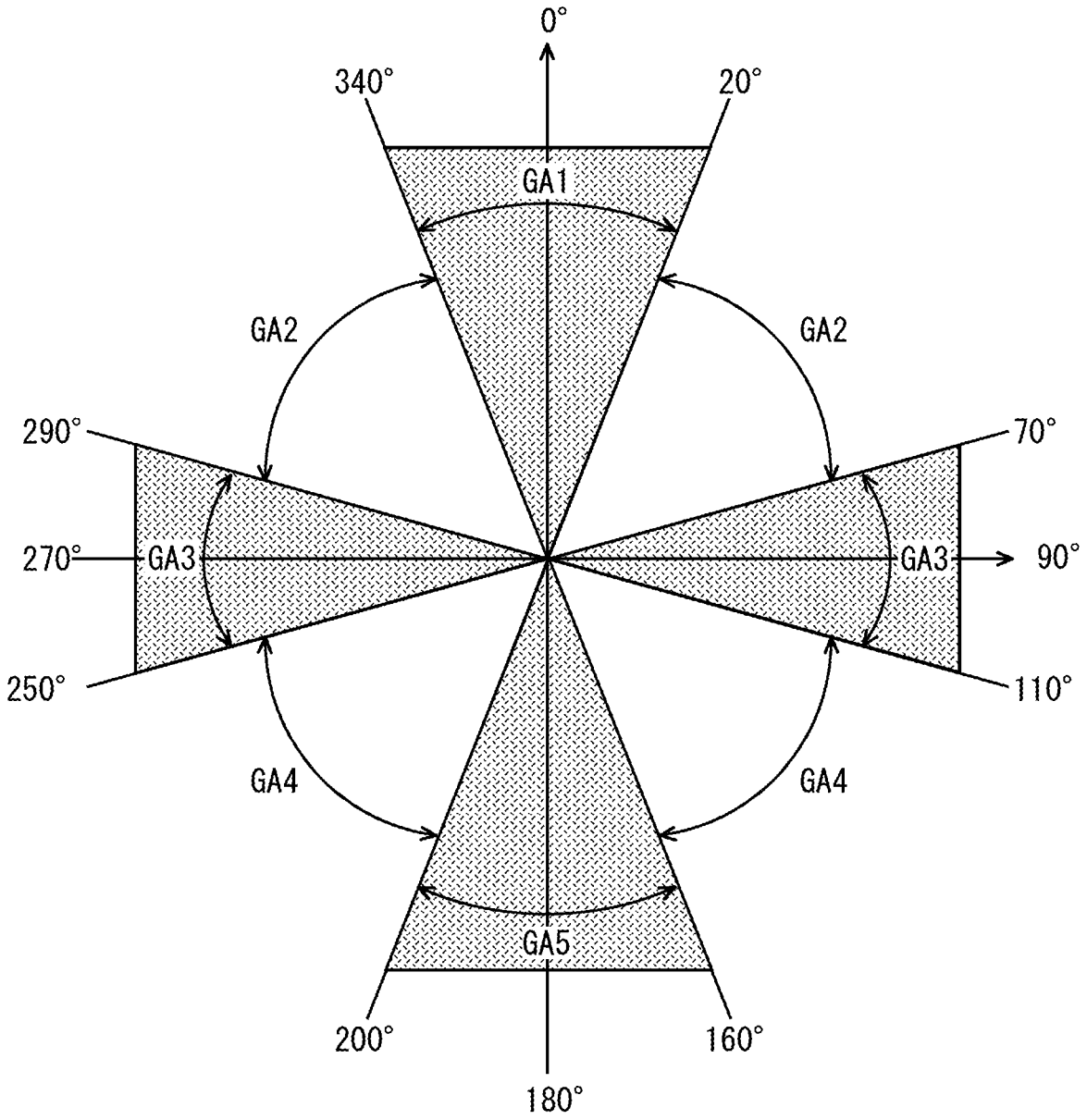
FIG. 7 is a view showing a determination area of a horizontal angle and a gain difference parameter.

Determination based on the gain difference is described next. In this embodiment, the measurement environment is divided into a plurality of areas based on the horizontal angle. Then, the effective range is set for each area. FIG. 7 is a view showing an example of areas divided based on the horizontal angle. As shown in FIG. 7, the measurement environment is radially divided into five areas GA1 to GA5. The angle shown in FIG. 7 is the azimuthal angle around the user U at the center, just like in FIG. 2. Note that the range from 0° to 180° and the range from 180° to 360° are symmetrical.

The area GA1 is 0° to 20° or 340° to 360°. The area GA2 is 20° to 70° or 290° to 340°. The area GA3 is 70° to 110° or 250° to 290°. The area GA4 is 110° to 160° or 200° to 250°. The area GA5 is 160° to 200°. The angular range of each area is not limited to the example shown in FIG. 7. Further, the number of divided areas may be 2 to 4, or 6 or more.

Figure 8:
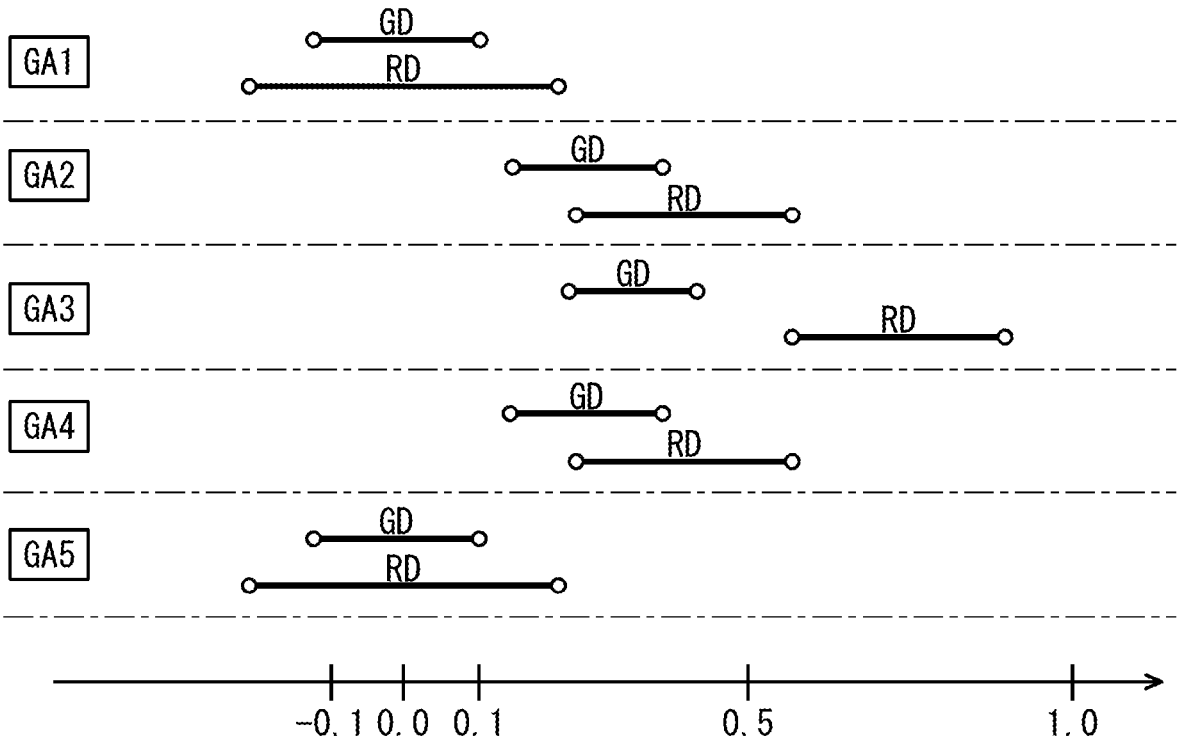
FIG. 8 is a view showing an effective range in accordance with an angular range.

In the determination unit 225, the effective ranges of the maximum value difference GD and the root-sum-square difference RD are set for each area. FIG. 8 shows a table containing the effective range of the maximum value difference GD and the effective range of the root-sum-square difference RD. The determination unit 225 stores the table shown in FIG. 8. In FIG. 8, the measured sound pickup signals S1 and S2 are normalized so that the square sum is 1.0 or less.

The determination unit 225 determines an area in which the sound source is located from the horizontal angle of the sound source (speaker 5L). In other words, the determination unit 225 determines in which of the areas GA1 to GA5 the speaker 5L is located. Then, when the maximum value difference GD and the root-sum-square difference RD are within the effective ranges, the determination unit 225 determines the result as good. On the other hand, when the maximum value difference GD and the root-sum-square difference RD are outside the effective ranges, the determination unit 225 determines the result as no good.

Although this method uses the areas divided as shown in FIG. 7 and the table of the effective ranges as shown in FIG. 8, the area division and the effective range table are not limited to the examples shown in FIGS. 7 and 8. Further, the effective ranges of the maximum value difference GD and the root-sum-square difference RD may be set by a mathematical expression, not limited to the table.

Figure 9:
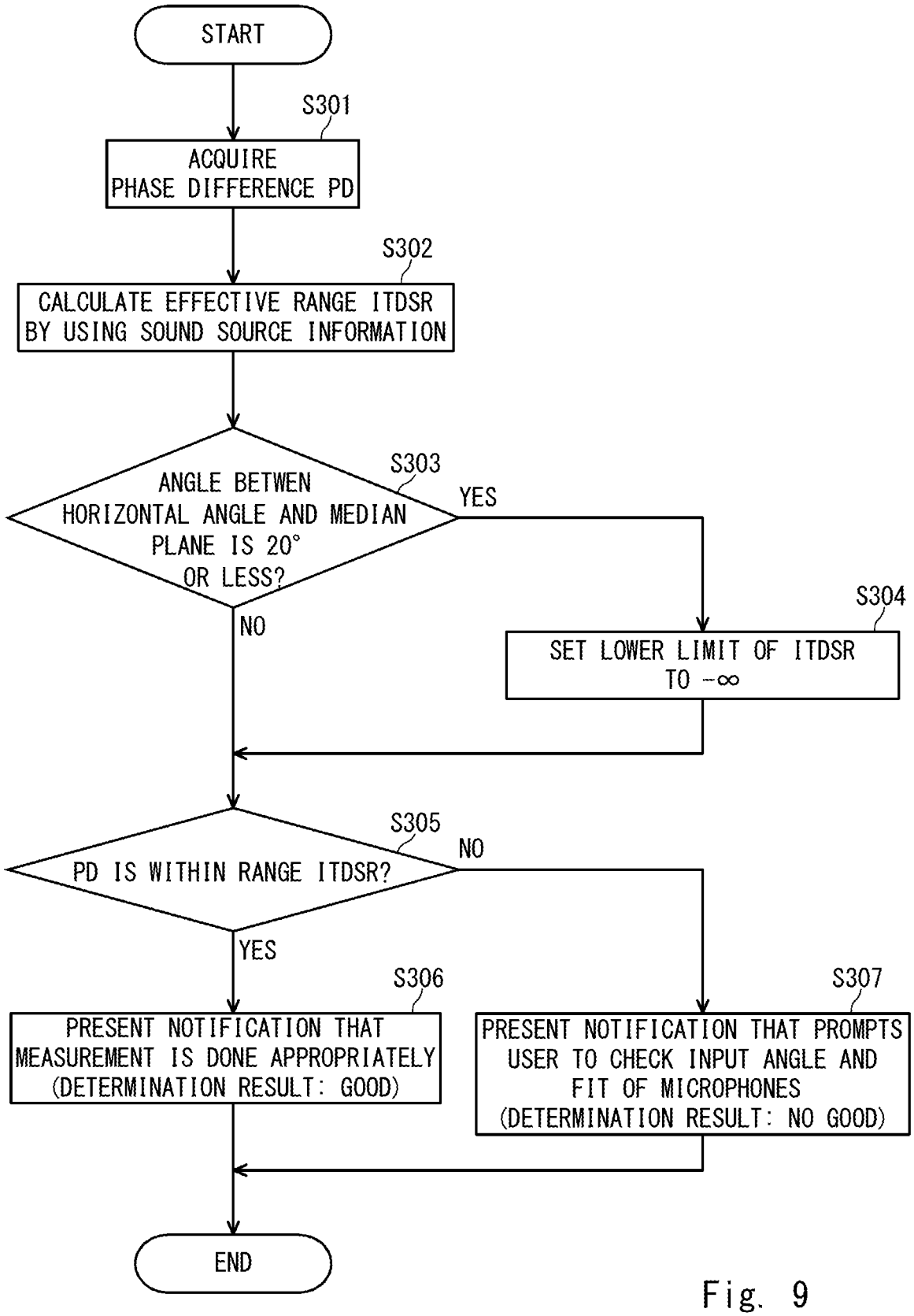
FIG. 9 is a view showing a determination flow based on a phase difference.

A process of phase difference determination is described hereinafter with reference to FIG. 9. FIG. 9 is a flowchart showing a process of phase difference determination.

First, the determination unit 225 acquires the phase difference PD from the phase difference detection unit 223 (S301). Next, the determination unit 225 calculates the effective range ITDSR by using the sound source information (S302). The determination unit 225 can calculate the effective range ITDSR of the phase difference by using the interaural time difference model as described above. Specifically, the determination unit 225 calculates the effective range ITDSR of the phase difference from the equation (2) by taking the effect of errors into account for the horizontal angle θ of the sound source. Further, the effective range ITDSR may be stored as a table associated with the horizontal angle.

The determination unit 225 determines whether an angle between the horizontal angle and the median plane is 20° or less (S303). In other words, the determination unit 225 determines whether the sound source is located in the area GA1. When this angle is not 20° or less (NO in S303), the determination unit 225 determines whether the phase difference PD is within the effective range ITDSR (S305).

When, on the other hand, the angle is 20° or less (Yes in S303), the determination unit 225 set the lower limit of the effective range ITDSR to −∞ (S304). After setting the lower limit, the determination unit 225 determines whether the phase difference PD is within the effective range ITDSR (S305). Thus, when the sound source is located in the area GA1, the determination unit 225 determines the result as good if it is below the upper limit of the effective range ITDSR based on the equation (2).

When the phase difference PD is within the effective range ITDSR (Yes in S305), the determination unit 225 determines the result as good, and the output unit 250 presents a notification that measurement is done appropriately (S306). When, on the other hand, the phase difference PD is not within the effective range ITDSR (No in S305), the determination unit 225 determines the result as no good, and the output unit 250 presents a notification that prompts the user to check the input angle and the fit of the microphones (S307). For example, the output unit 250 presents a display that prompts the user to check if measurement microphones are worn wrong way round. Further, the output unit 250 presents a display that prompts the user to check the horizontal angle input by the user U. Furthermore, the output unit 250 presents a display that prompts the user to perform remeasurement without fail after adjusting the fit of microphones or the input horizontal angle.

Viewing this display, the user U checks whether the microphones 2L and 2R are worn wrong way round. Further, the user U checks whether the horizontal angle input at the start of measurement is appropriate. The user U modifies the input of the horizontal angle and the fit of microphones and then carries out measurement again.

Figure 10:
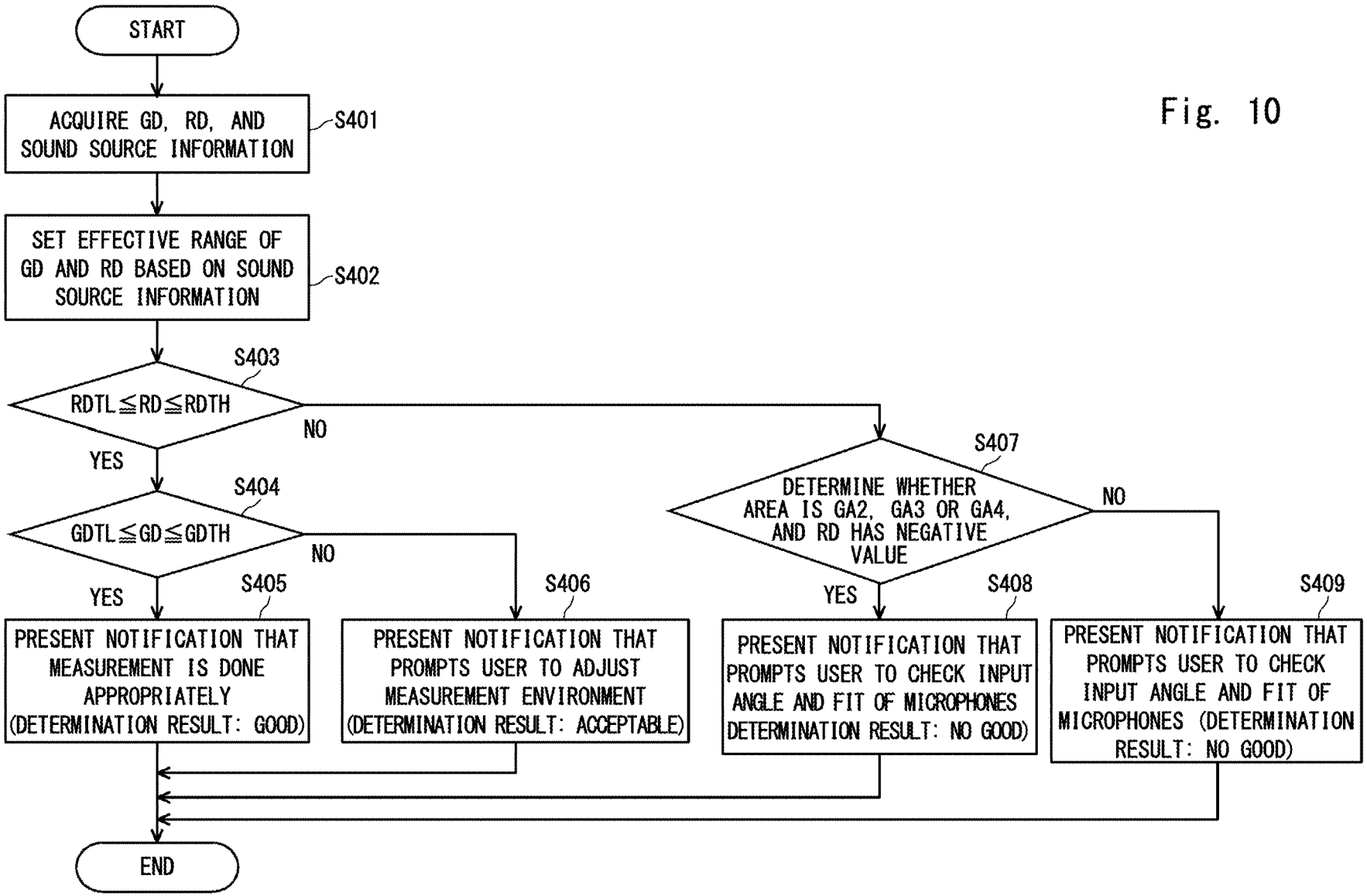
FIG. 10 is a view showing a determination flow based on a gain difference.

Determination using the gain difference is described hereinafter with reference to FIG. 10. FIG. 10 is a flowchart showing an example of a process of gain difference determination.

The determination unit 225 acquires the maximum value difference GD, the root-sum-square difference RD, and the sound source information (S401). The determination unit 225 sets the effective range of the maximum value difference GD and the effective range of the root-sum-square difference RD based on the sound source information (S402). For example, the effective ranges are set based on the sound source information by reference to the table shown in FIG. 8.

The effective range of the maximum value difference GD is defined by an upper limit GDTH and a lower limit GDTL. Thus, the effective range of the maximum value difference GD is GDTL to GDTH. The effective range of the root-sum-square difference RD is defined by an upper limit RDTH and a lower limit RDTL. Thus, the effective range of the root-sum-square difference RD is RDTL to RDTH. The effective ranges may be specified by one of the upper limit and the lower limit.

The determination unit 225 determines whether the root-sum-square difference RD is equal to or larger than the lower limit RDTL and equal to or smaller than the upper limit RDTH (S403). The determination unit 225 thereby determines whether the root-sum-square difference RD is within the effective range (RDTL to RDTH).

When the root-sum-square difference RD is equal to or larger than the lower limit RDTL and equal to or smaller than the upper limit RDTH (Yes in S403), the determination unit 225 determines whether the maximum value difference GD is equal to or larger than the lower limit GDTL and equal to or smaller than the upper limit GDTH (S404). The determination unit 225 thereby determines whether the maximum value difference GD is within the effective range (GDTL to GDTH).

When the maximum value difference GD is equal to or larger than the lower limit GDTL and equal to or smaller than the upper limit GDTH (Yes in S404), the determination unit 225 determines the result as "good", and the output unit 250 presents a notification that measurement is done appropriately (S405). Because the maximum value difference GD and the root-sum-square difference RD are within the respective effective ranges, the determination unit 225 determines that the result of measurement is good.

When the maximum value difference GD is not equal to or larger than the lower limit GDTL and equal to or smaller than the upper limit GDTH (No in S404), the determination unit 225 determines the result as "acceptable", and the output unit 250 presents a notification that prompts the user to adjust the measurement environment (S406). Specifically, it is presented that adjustment of the measurement environment is needed because there is much reflection on the wall surface on the opposite side from the sound source, a reflecting object or the like. To be specific, the output unit 250 presents a display to make adjustment of the surrounding environment of the output unit 250 because reflection is significant due to the presence of the wall surface on the opposite side from the sound source, some reflecting object or the like, which can hinder achievement of appropriate effects.

When the root-sum-square difference RD is not equal to or larger than the lower limit RDTL and equal to or smaller than the upper limit RDTH (No in S403), the determination unit 225 determines whether the area is GA2, GA3 or GA4, and the root-sum-square difference RD has a negative value (S407). Specifically, the determination unit 225 determines whether the horizontal angle of the sound source belongs to GA2, GA3 or GA4 and also determines whether the root-sum-square difference RD is smaller than 0.

When the area is GA2, GA3 or GA4, and the root-sum-square difference RD has a negative value (Yes in S407), the determination unit 225 determines the result as "no good", and the output unit 250 presents a notification that prompts the user to check the input angle and the fit of microphones (S408). In this case, the user checks the input angle and the fit of microphones. For example, the user U checks whether the microphones 2L and 2R are worn wrong way round. Further, the user U checks whether the horizontal angle input at the start of measurement is appropriate. In this case, the output unit 250 presents a display that prompts the user to perform remeasurement without fail. Viewing this display, the user U modifies the input of the horizontal angle and the fit of microphones, and then carries out remeasurement.

On the other hand, when the area is not GA2, GA3 or GA4, or when the root-sum-square difference RD does not have a negative value (No in S407), the determination unit 225 determines the result as "no good", and the output unit 250 presents a notification that prompts the user to check the input angle and the microphone sensitivity (S409). In this case, the user checks the horizontal angle and the sensitivity of microphones. For example, the user U checks whether the sensitivity of the microphone 2L and the sensitivity of the microphone 2R are at the same level. Note that the signal processing device 201 includes the function of determining and adjusting the microphone sensitivity, and it checks the sensitivity of left and right microphones. The user U checks whether the horizontal angle input at the start of measurement is appropriate. In this case, the output unit 250 presents a display that prompts the user to perform remeasurement without fail. Viewing this display, the user U modifies the input of the horizontal angle and the sensitivity of microphones, and then carries out remeasurement.

In this manner, the determination unit 225 compares the gain difference with the effective range and thereby determines the result in three levels: good, acceptable, and no good. Then, the output unit 250 presents what is to be adjusted based on the determination result in the determination unit 225. For example, the output unit 250 displays a notification that prompts the user to check the fit of microphones, the input angle or the sensitivity of microphones. In response to this display, the user U can adjust the fit of microphones, the input angle, the sensitivity of microphones, the reflecting surface such as the wall surface and the like, and then carry out remeasurement. This enables appropriate measurement of sound pickup signals. It is thereby possible to acquire an appropriate out-of-head localization filter.

Second Embodiment

A signal processing device 201 according to a second embodiment is described hereinafter with reference to FIG.

Figure 11:
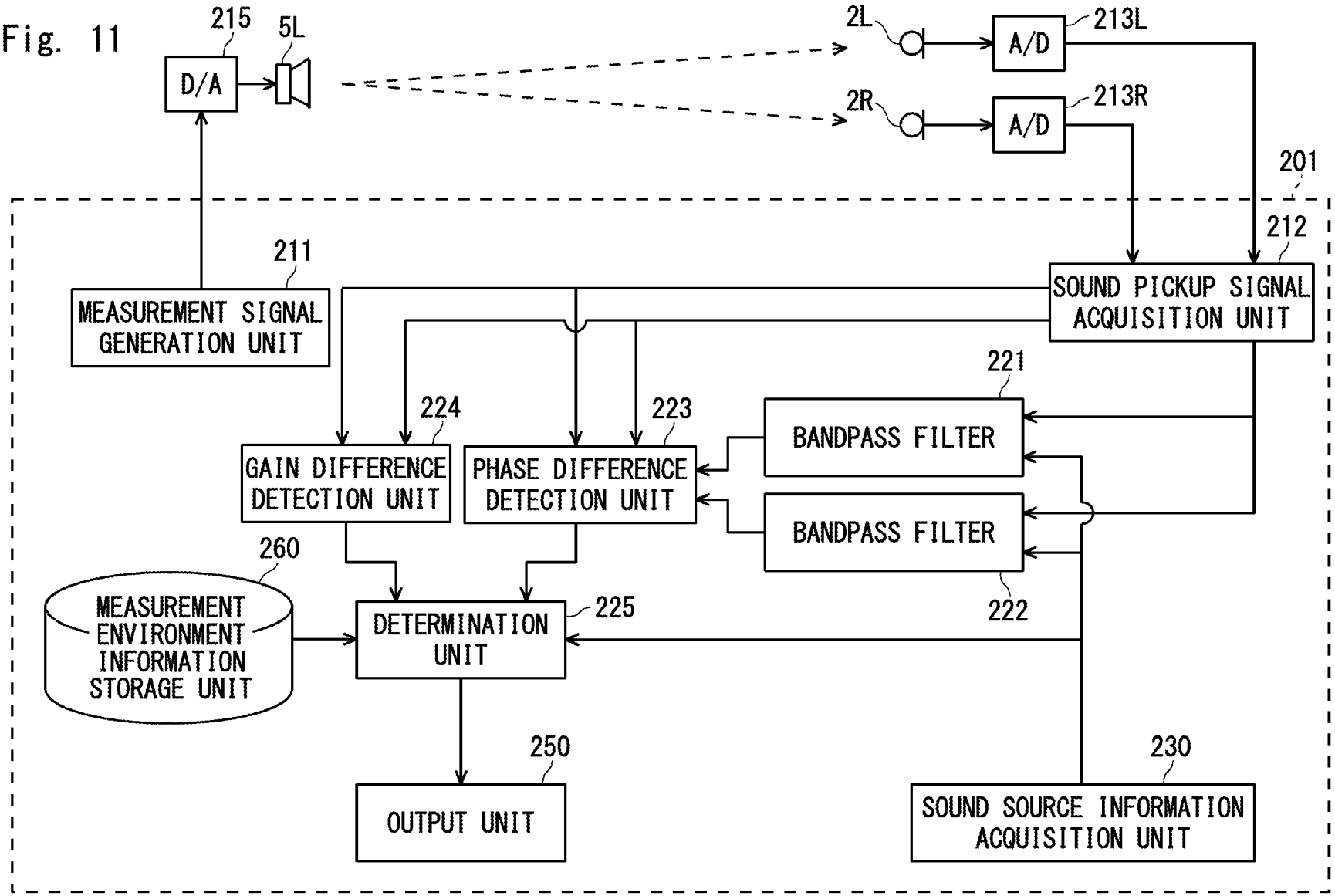
FIG. 11 is a control block diagram showing the structure of a signal processing device according to a second embodiment.

11. FIG. 11 is a block diagram showing the structure of the signal processing device 201. As shown in FIG. 11, the signal processing device 201 according to this embodiment further includes a measurement environment information storage unit 260, in addition to the structure described in the first embodiment. Note that the components other than the measurement environment information storage unit 260 and the control are the same as those described in the first embodiment and thus not redundantly described below.

While the effective ranges and the passbands are set using the sound source angle information only in the first embodiment, the effective ranges and the passbands are set in accordance with the measurement environment stored in the measurement environment information storage unit 260 in this embodiment. For example, there is a case where the influence of not only direct sound but also reflected sound reflected on a wall surface, a ceiling or the like is not negligible in some actual environment where sound pickup signals are measured. In such a case, not only the sound source angle information but also the ceiling height of the room, the distance to the wall of the room and the like, for example, are input and stored as measurement environment information into the measurement environment information storage unit 260. By carrying out simulation of reflected sound, the evaluation function for determining the effective ranges of the phase difference or the passband table of the bandpass filters may be changed.

The measurement environment information stored in the measurement environment information storage unit 260 may be used also for the gain difference determination. For example, in the gain difference determination also, the table may be changed as appropriate using the measurement environment information, just like in the phase difference determination. Then, the table changed according to the measurement environment information may be stored in the measurement environment information storage unit 260. Further, the information stored in the measurement environment information storage unit 260 may be learned according to the measurement environment.

A part or the whole of the above-described processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as floppy disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire or optical fiber or a wireless communication line.

Although embodiments of the invention made by the present invention are described in the foregoing, the present invention is not restricted to the above-described embodiments, and various changes and modifications may be made without departing from the scope of the invention.

The present disclosure is applicable to out-of-head localization technology.

What is claimed is:

1. A signal processing device for processing sound pickup signals obtained by picking up a sound output from a sound source by a plurality of microphones worn on a user, comprising:

a measurement signal generation unit configured to generate a measurement signal to be output from the sound source;

a sound pickup signal acquisition unit configured to acquire sound pickup signals picked up by the plurality of microphones;

a sound source information acquisition unit configured to acquire sound source information related to a horizontal angle of the sound source;

a filter configured to have a passband set based on the sound source information, and output a filter passing signal in response to input of the sound pickup signals;

a phase difference detection unit configured to detect a phase difference between two sound pickup signals based on the filter passing signal; and a determination unit configured to determine a result of measurement of the sound pickup signals by comparing the phase difference with an effective range set based on the sound source information.

2. The signal processing device according to claim 1, further comprising:

a gain difference detection unit configured to detect a gain difference between the two sound pickup signals, wherein the determination unit determines a result of measurement of the sound pickup signals by comparing the gain difference with an effective range set based on the sound source information.

3. The signal processing device according to claim 1, wherein, when the horizontal angle in a forward direction of the user is 0°, the horizontal angle in a right direction is 90°, the horizontal angle in a rearward direction is 180°, and the horizontal angle in a left direction is 270°, the passband of the filter at 90° or 270° is lower than the passband of the filter at other horizontal angles.

4. The signal processing device according to claim 1, wherein a filter for out-of-head localization is generated based on the sound pickup signals.

5. A signal processing method for processing sound pickup signals obtained by picking up a sound output from a sound source by a plurality of microphones worn on a user, the method comprising:

a step of generating a measurement signal to be output from the sound source;

a step of acquiring sound pickup signals picked up by the plurality of microphones;

a step of acquiring sound source information related to a horizontal angle of the sound source;

a step of inputting the sound pickup signals to a filter having a passband set based on the sound source information;

a step of detecting a phase difference between two sound pickup signals based on a filter passing signal that has passed through the filter; and a step of determining a result of measurement of the sound pickup signals by comparing the phase difference with an effective range set based on the sound source information.

6. A non-transitory computer readable medium storing a program causing a computer to execute a signal processing method for processing sound pickup signals obtained by picking up a sound output from a sound source by a plurality of microphones worn on a user, the signal processing method comprising:

a step of generating a measurement signal to be output from the sound source;

a step of acquiring sound pickup signals picked up by the plurality of microphones;

a step of acquiring sound source information related to a horizontal angle of the sound source;

a step of inputting the sound pickup signals to a filter having a passband set based on the sound source information;

a step of detecting a phase difference between two sound pickup signals based on a filter passing signal having passed through the filter; and a step of determining a result of measurement of the sound pickup signals by comparing the phase difference with an effective range set based on the sound source information.

* * * * *